US005987647A

United States Patent [19]

Ouellette

[11] Patent Number: 5,987,647

[45] Date of Patent: Nov. 23, 1999

[54] WOMEN'S HEADBAND ITS METHOD OF CONSTRUCTION

[76] Inventor: Jennifer Ouellette, 690 Fort Washington 4F, New York, N.Y. 10040

[21] Appl. No.: 09/178,156

[22] Filed: Oct. 23, 1998

[51] Int. Cl.[6] ..... A41D 19/02

[52] U.S. Cl. ..... 2/171; 2/DIG. 11; 132/273

[58] Field of Search ..... 2/171, 207, DIG. 11; 132/273

[56] References Cited

U.S. PATENT DOCUMENTS

| | | | |
|---|---|---|---|
| 3,471,867 | 10/1969 | Kirchhoff | 132/273 |
| 5,233,704 | 8/1993 | Booher | 2/207 |
| 5,867,833 | 2/1999 | Ledonne | 2/171 |

*Primary Examiner*—Diana Oleksa
*Attorney, Agent, or Firm*—Howell & Haferkamp, LC

[57] ABSTRACT

A headband and its method of construction requires only a few sections of cloth or fabric that are sewn together in a minimum number of simplified steps in constructing the headband.

20 Claims, 6 Drawing Sheets

WOMEN'S HEADBAND ITS METHOD OF CONSTRUCTION

BACKGROUND OF THE INVENTION (1) Field of the Invention

The present invention pertains to a woman's headband and its method of construction which requires only a few sections of cloth or fabric that are sewn together in a minimum number of simplified steps.

(2) Description of the Related Art

Women's headbands come in many types and many constructions. The more elaborate and expensive appearing headbands are typically constructed of cloth. Often these are constructed of several sections of cloth that are brought together in an appealing design and are further decorated by pieces of trim. A resilient hoop is usually contained in the headband for maintaining the headband at its desired position on the woman's head.

In the construction of the more elaborate headbands, the several sections of cloth and the trim increase their cost of manufacture. When compared with more simple headband constructions, the increase in the cost of manufacturing more elaborate headbands is significant. The manufacturing costs are not only increased due to the increased amount of material that goes into the headband's construction, but also due to the increased time required to manufacture the headband due to additional manufacturing steps not required in the construction of more simpler headbands. When the headband construction is so elaborate that it cannot be performed by machine but requires manual assembly of the component parts, the cost of manufacture is further increased.

An improved headband construction that brings together the several different sections of cloth and trim of the more elaborate headbands in a minimal number of simplified construction steps would overcome the drawbacks in prior art constructions of headbands.

SUMMARY OF THE INVENTION

The present invention provides a headband having an elaborate, appealing appearance, and in particular a method of constructing the headband that involves only a minimal number of simplified construction steps to produce the elaborate appearance of the headband's construction.

The headband is basically constructed of three sections of cloth, some trim and a resilient hoop. Layers of interfacing and foam are also employed in the interior of the headband's construction. In more simplified embodiments, one or more sections of the cloth are removed.

The three sections of cloth include a top section, a bottom section and an intermediate section. All of the sections of cloth have a longitudinal length that is substantially larger than their lateral width. The longitudinal length of the cloth sections is sufficiently long to extend from adjacent the ear on one side of the head, across the top of the head to adjacent the ear on the opposite side of the head. Depending on the cloth used for the sections, the sections may be backed with a fusible interfacing.

The top section is cut so that a first longitudinal edge is generally straight and the laterally opposite second longitudinal edge curves gradually toward the first edge at its opposite ends. The bottom section and the intermediate section are left with their generally rectangular configurations for the time being.

The generally straight, first longitudinal edge of the top section is sewn to a first longitudinal edge of the intermediate section. A first longitudinal edge of the bottom section is sewn to the second longitudinal edge of the intermediate section. The three sewn sections form one piece of cloth with the sewn seams positioned on the same side of the piece of cloth. The cloth piece formed by the three sewn sections is then pressed flat.

The cloth piece is then folded over with the fold line extending across the top section so that the top section overlaps the intermediate and bottom sections with the sewn seems within the fold. The second lateral edge of the bottom section is then cut so that its shape matches that of the second lateral edge of the top section.

A racetrack of trim is then formed with a generally oval configuration matching that of the perimeter of the cloth piece formed by three cloth sections. The race track is placed on the right side of the cloth piece, that being the side opposite the sewn seams between the cloth sections. The racetrack is sewn to the cloth piece around its perimeter. Alternatively, a length of soutache can be sewn around the perimeter of the cloth piece instead of the racetrack.

A layer of foam is then sewn to the cloth piece on the side of the cloth piece having the sewn seams. The layer of foam is positioned adjacent only the backside of the top section and is sewn only along the section of the cloth piece perimeter defined by the top section.

The cloth piece is then folded over with the sewn seams positioned within the fold. The portion of the trim, whether racetrack or soutache, sewn along the second edge of the top section is positioned overlapping and projecting slightly beyond the portion of the trim sewn along the second edge of the bottom section. The top section and bottom section are then sewn together along their entire lengths except for two segments of the trim adjacent to the fold. These two segments of the trim define a gap for the later insertion of the resilient hoop into the headband. The headband is then pressed on a curved block to give it a roundness to match the curvature of the head. After the pressing, the resilient hoop is inserted through the gap between the sections of the trim and the gap is sewn closed, completing the construction of the headband.

The method of construction produces a headband having a top section of cloth that is predominately visible when the headband is worn and that curves around and under the rearward edge of the resilient hoop contained in the headband. The narrow intermediate section adjacent to the rearward edge of the headband and the bottom section of cloth rest on the head of the wearer. The trim extends along the forward edge of the headband and is visible at the forward edge of the top section of cloth. The three different sections of cloth employed as well as the racetrack trim give the headband an elaborate design that appears to require costly construction, but is inexpensively manufactured by the simplified steps of the method of the invention.

BRIEF DESCRIPTION OF THE DRAWINGS

Further objects and features of the present invention are revealed in the following detailed description of the preferred embodiment of the invention and in the drawing Figures wherein.

DESCRIPTION OF THE PREFERRED EMBODIMENTS

Figure 1:
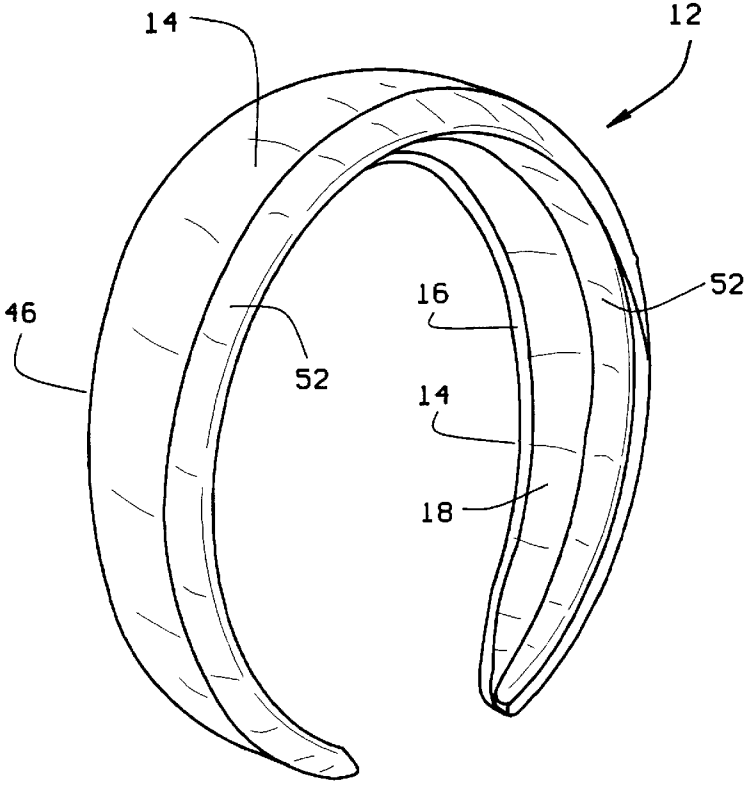
FIG. 1 is a side perspective view of the front of the headband of the invention constructed according to the method of the invention.

The headband of the invention 12 constructed according to the method of the invention is shown in FIG. 1. The preferred embodiment of the headband 12 is constructed from several sections of fabric that are sewn together and contain a resilient hoop that maintains the headband in its configuration shown in FIG. 1. The resilient hoop employed in the preferred embodiment is a common, commercially available plastic headband. However, other types of resilient hoops may be employed and the phrase "resilient hoop" as used herein is intend to include all of the various types of commercially available resilient headbands.

In the preferred embodiment of the headband, the headband is constructed of three sections of fabric or cloth as will be described. Describing the three sections as being of "cloth" is intended to cover the many different types of materials employed in the construction of apparel. For example, "cloth" includes but is not limited to materials such as ribbon, straw, horsehair, grosgrain, sewn braids, felt, as well as any other similar type of material commonly employed in the construction of apparel. In the detailed description of the headband and its method of construction to follow, particular materials are described as being employed in the construction of sections of the headband. These particular materials are illustrative only and should not be interpreted as limiting the construction of the headband to any particular type of material. Therefore, the sections of the headband to be described will be generally referred to as "cloth" sections with it being intended that "cloth" include any materials of the type discussed above.

Figure 2:
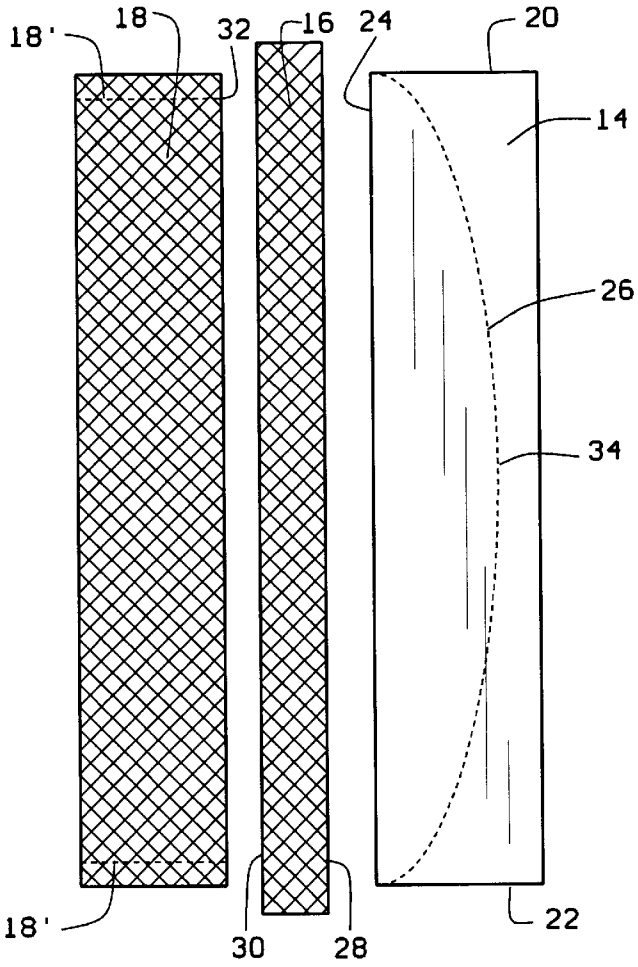
FIG. 2 is a plan view of the three sections of cloth employed in constructed the preferred embodiment of the headband according to the preferred method of construction.

FIG. 2 illustrates an initial step in the method of constructing the headband 12 of FIG. 1 according to the method of the invention. The headband is basically constructed of a top section of cloth 14, an intermediate section of cloth 16, and a bottom section of cloth 18. The top section of cloth 14 has a generally rectangular, elongated configuration with a length between opposite lateral edges 20, 22 of the section of cloth being substantially larger than a width between opposite longitudinal edges 24, 26 of the section of cloth. The intermediate section of cloth 16 has a longitudinal length that is slightly larger than the longitudinal length of the top section 14, and the bottom section of cloth 18 has a longitudinal length that is the same length as the top section 14 when a woven material like horsehair is used, and is slightly smaller than the length of the top section 14, about ⅜ of an inch shorter at its opposite ends (represented by the dashed lines 18' in FIGS. 2, 4A and 5A) when a non-woven material is used. In the method of construction, it is not necessary that the three sections of cloth 14, 16, 18 have rectangular configurations in the initial construction steps. The cloth sections will be cut to their desired shape in later steps in the construction method. However, it is necessary that the top and bottom sections have at least one straight longitudinal edge and that the intermediate section have straight opposite longitudinal edges. As shown in FIG. 2, a first longitudinal edge 24 of the top section is the required straight longitudinal edge of this section. The intermediate section of cloth 16 has first 28 and second 30 opposite longitudinal edges that are straight. The bottom section of cloth 18 has a first longitudinal edge 32 that is straight. The second longitudinal edge of the bottom section will be defined in later steps of the method.

The second longitudinal edge 26 of the top section of cloth 14 is defined by a gradually arcing line 34 cut into this section of cloth along the dotted line shown in FIG. 2. This will be the forward edge of the headband. Other shapes for the forward edge may be employed. For example, the second longitudinal edge 26 could be defined by a pair of arcs cut into this section of cloth that both meet at the longitudinal center of the section of cloth 14. The second longitudinal edge 26 of the top section of cloth 14 can be formed with any desired longitudinal length for the intended wearer of the headband. The longitudinal length must be sufficiently long to extend from adjacent the ear on one side of the head, across the top of the head to adjacent the ear on the opposite side of the head.

In the preferred embodiment of the invention, each of the three sections of cloth 14, 16, 18 are backed with fusible interfacing of the type commercially available. The fusible interfacing is applied to only one side of the three sections, the side being that which will not be visible on the completed headband. The interfacing is added to the cloth sections to prevent the fraying of the cloth and also to obscure stitching lines in the interior of the finished headband.

Figure 3A:
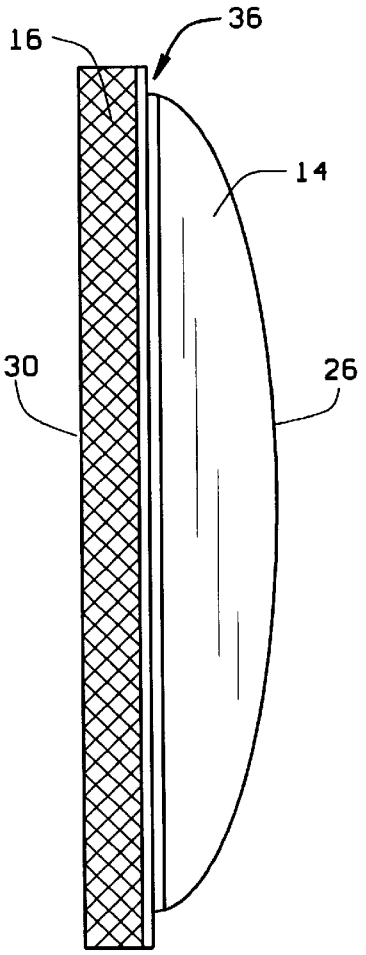
FIGS. 3A and 3B are respective plan and side elevation views of an initial step of the headband construction.
Figure 3B:
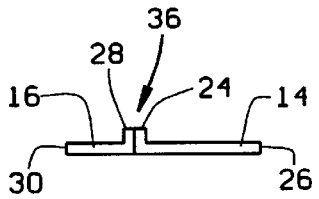

The first longitudinal edge 24 of the top section of cloth 14 is sewn to the first longitudinal edge 28 of the intermediate section of cloth 16. In the preferred embodiment of the invention, the intermediate section of cloth is a narrow grosgrain ribbon. The two longitudinal edges are sewn together with a narrow seam allowance as shown in FIGS. 3A and 3B.

Figure 4A:
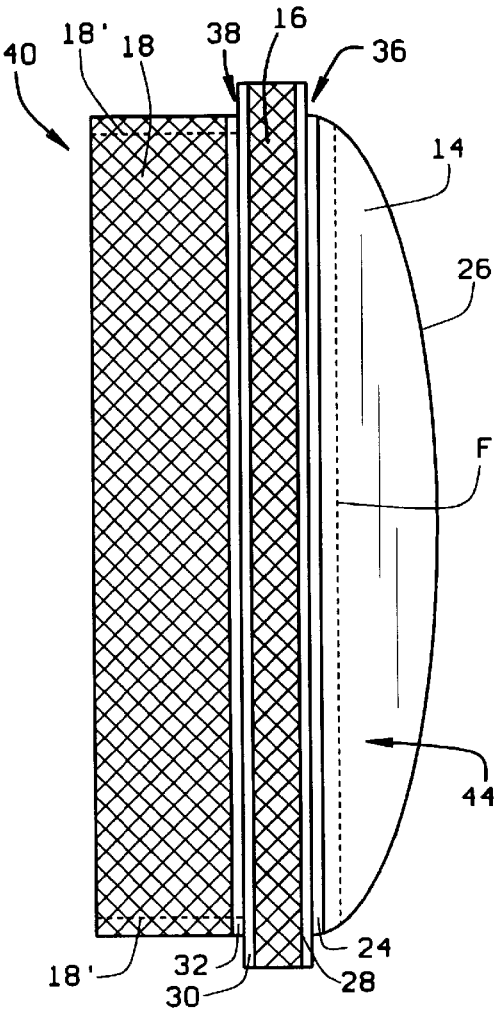
FIGS. 4A and 4B are respective plan and elevation views of a subsequent step of the headband construction.
Figure 4B:
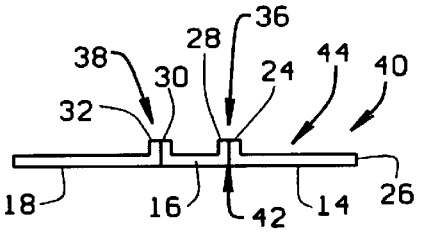

The first longitudinal edge 32 of the bottom section of cloth 18 is then sewn along the second longitudinal edge 30 of the intermediate section of cloth 16 as shown in FIGS. 4A and 4B. Again, the two longitudinal edges are sewn with a narrow seam allowance. In the preferred embodiment of the invention, the bottom section of cloth 18 is horsehair or felt, although other materials may be employed as set forth above.

The three sewn together sections 14, 16, 18 of cloth together define one piece of cloth 40 with the sewn seams 36, 38 positioned on one side of the cloth piece as shown in FIG. 4B. The reverse side of the cloth piece 40 from the sewn seams 36, 38 is referred to as the right side, meaning that side that will be the exterior of the headband at the end of its construction. The opposite side 44 is that side of the cloth piece 40 opposite the right side 42 and on which the two seams 36, 38 are formed. This opposite side 44 will be contained within the construction of the headband when the construction is completed. The three sections of cloth 14, 16, 18, together defining the cloth piece 40, are then pressed flat as shown in FIGS. 4A and 4B.

Figure 6:
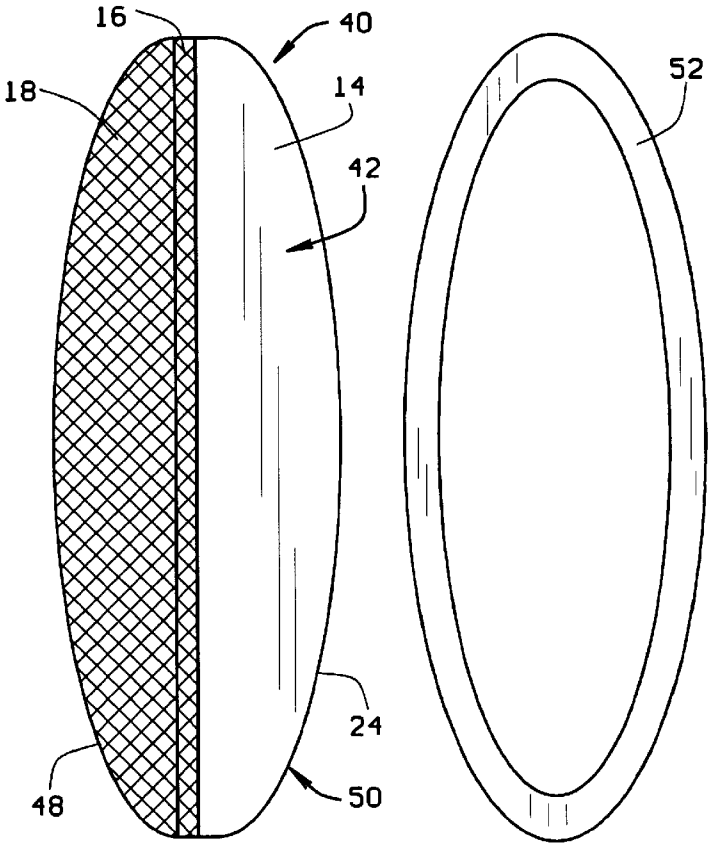
FIG. 6 is a plan view of a cloth piece constructed from the three cloth sections of the headband and a racetrack trim.
Figure 5A:
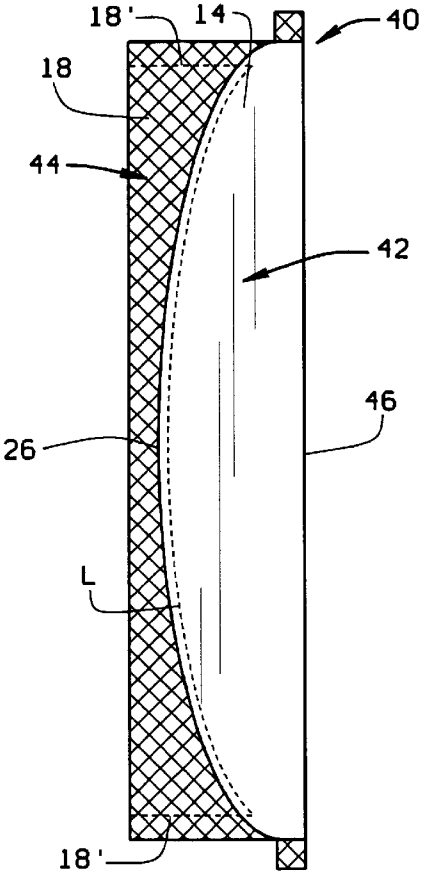
FIGS. 5A and 5B are respective plan and elevation views of a further step of the headband construction.
Figure 5B:
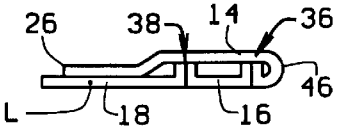

The cloth piece 40 is next folded over at the fold line F shown in FIG. 4A so that the top section 14 overlaps the bottom section 16 with the pair of seams 36, 38 within the fold as shown in FIGS. 5A and 5B. In a preferred embodiment, the fold 46 is actually formed in the top section of cloth 14 adjacent its seam 36 connecting it to the intermediate section of cloth 16. With the fold so positioned, the cloth of the top section 14 is visible at the rearward edge of the finished headband defined by the fold 46 and the cloth of the intermediate section 16 is just below and forward of this rearward edge. The folded cloth piece is then pressed flat so that the second longitudinal edge 26 of the cloth top section 14 lies flat against the cloth bottom section 18. The second longitudinal edge 48 of the cloth bottom section 18 is then formed by marking a line L on the bottom section 18 along the second edge 26 of the top section 14 and then cutting the cloth bottom section 18 just inside or to the right of the line L as shown in FIGS. 5A and 5B. This results in the second edge 26 of the top section, which will be the forward edge of the headband, slightly overlapping and extending beyond the second edge 48 of the bottom section 18 when the cloth piece is folded as shown in FIG. 5A. This cutting step performed on the cloth bottom section 18 gives the cloth piece 40 a generally oval perimeter edge 50 as shown in FIG. 6. This cutting step is performed where the trim to be added to the cloth piece is stitched to the right side of cloth 40 and adjacent to the perimeter edges of the intermediate section 16 and the bottom section 18 and the stitching will prevent the fraying of the edges of these two sections. However, where the trim is attached along the perimeter edges of the intermediate section 16 and the bottom section 18, for example when the bottom section is a thicker material such as felt, the opposite ends of the intermediate section are not cut but are left at their length shown in FIG. 5A. The bottom section 18 is still cut along the line L. The extending portions of the intermediate section are folded inwardly toward each other when the trim is added as will be explained below.

The next construction step adds trim to the cloth piece perimeter edge 50. A first way to add trim involves making a generally oval-shaped "racetrack" 52 of trim material. The racetrack 52 is dimensioned so that it will overlap the perimeter edge 50 of the cloth piece 40 defined by the three cloth sections 14, 16, 18. The racetrack 52 is shown positioned adjacent the flat cloth piece 40 in FIG. 6. The racetrack 52 can be given any width dimension desired and from any type of cloth desired. In this embodiment, the racetrack 52 is formed from a narrow strand of straw braid that is formed in a loop and spiraled around itself several times until the loop has the desired width dimension of the racetrack. Adjacent spirals of the straw braid are sewn together on a conventional sewn straw machine. Many different types of straw braid may be employed in constructing the loop of racetrack trim 52, as well as any desired type of cloth. The material of the racetrack trim 52 is pressed flat so that its perimeter configuration conforms to that of the perimeter edge 50 of the cloth piece 40.

Figure 7:
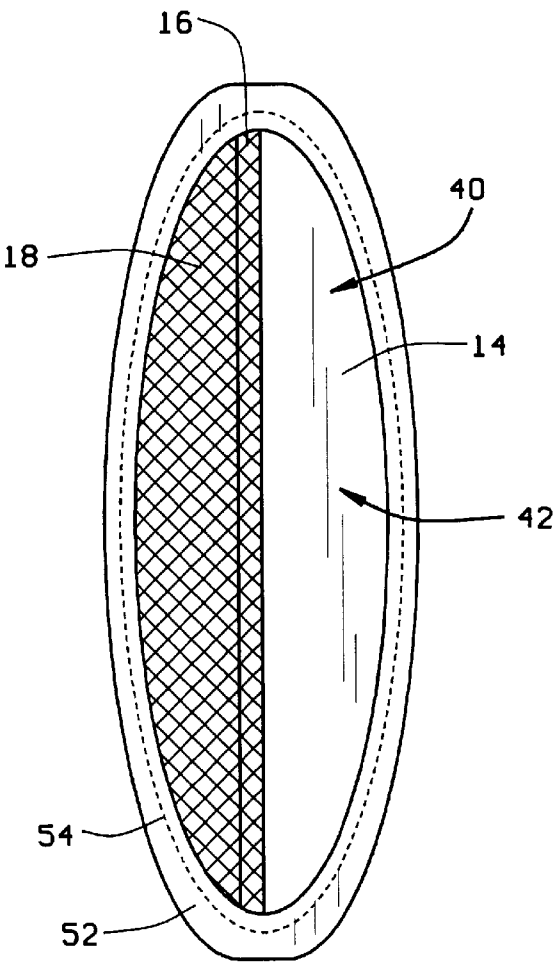
FIG. 7 is a plan view of the right side of the cloth piece with the racetrack trim attached.

The racetrack trim 52 is placed on the right side 42 of the cloth piece 40 overlying its perimeter edge 50 and is sewn in place as shown in FIG. 7. The straw braid is used in constructing the racetrack trim 52 in this embodiment for its ability to conceal the line of stitching 54 formed when sewing the trim 52 to the perimeter edge 50 of the cloth piece 40. The wider trim 52 also enables the line of stitching to be spaced slightly inwardly of the perimeter edges of the intermediate section 16 and bottom section 18 and thereby prevents the fraying of these perimeter edges when the two sections are constructed of materials such as grosgrain and horsehair.

Figure 13:
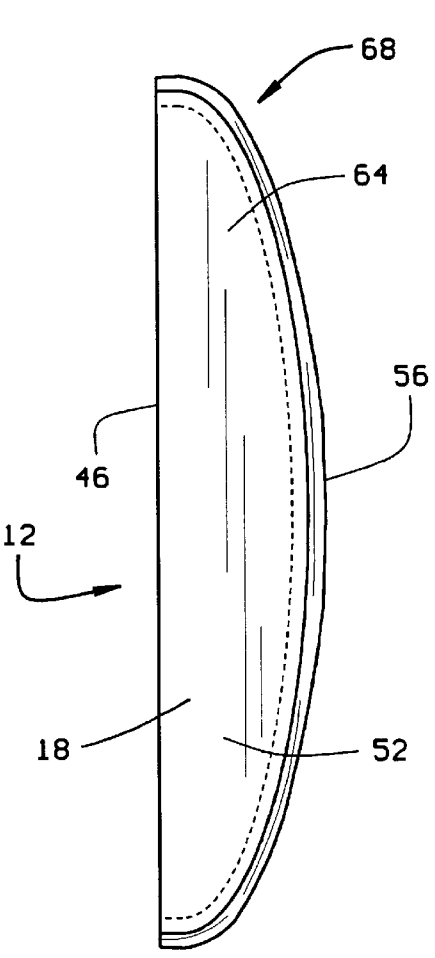
FIG. 13 is a view similar to FIG. 9 but showing the soutache trim.
Figure 12:
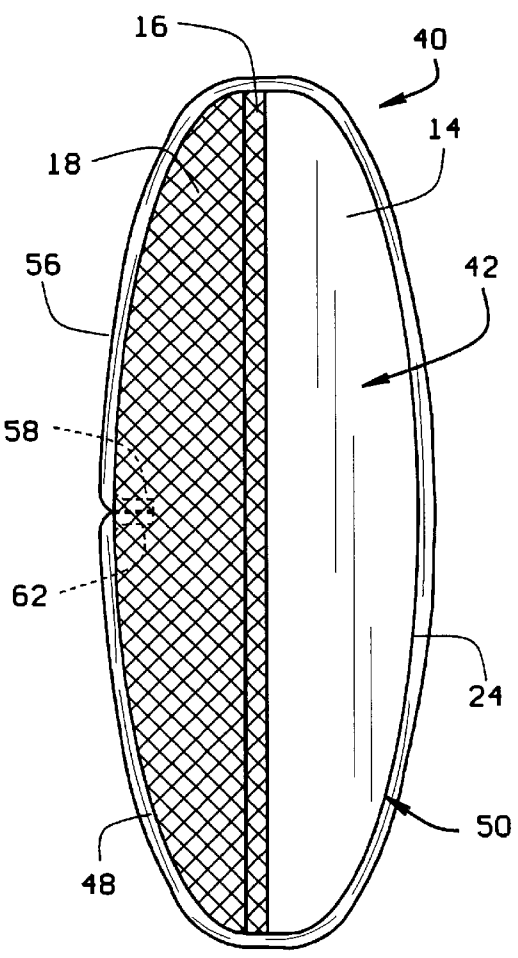
FIG. 12 is a view similar to FIG. 7 showing the trim completely attached.
Figure 11:
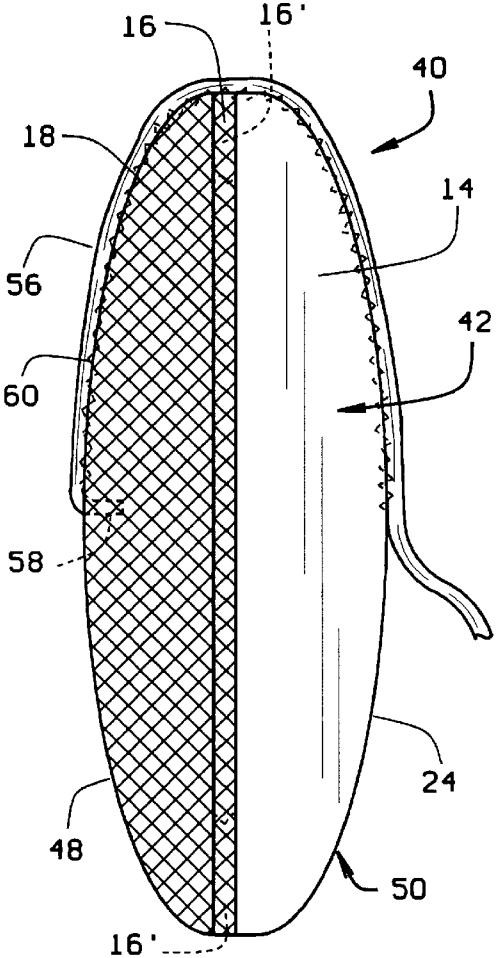
FIG. 11 is a view similar to FIG. 7 but showing felt in lieu of horsehair and soutache trim employed in lieu of the racetrack trim.

FIGS. 11–13 show an alternative to the racetrack trim 52. The trim added to the cloth piece 50 shown in these drawing figures is a length of narrower trim, for example, soutache 56. When a narrower trim is used it will be attached along the perimeter edges of the top section 14 and the bottom section 18. Therefore, it is preferable to use a material that will not fray along its edges for these two sections, for example felt. Also, to prevent the fraying of the opposite ends of the intermediate section 16 when it is constructed of grosgrain, the opposite ends are not cut as in FIG. 6 but are folded toward each other against the opposite side of 44 of the cloth piece. The steps in attaching the length of soutache trim 56 to the cloth piece 50 are very similar to that for the racetrack trim. As shown in FIGS. 11 and 12, the cloth piece 40 is positioned with the right side 42 facing upwardly and the opposite ends 16' of the intermediate section folded underneath. A first end 58 of the length of soutache is tucked under the second longitudinal edge 48 of the bottom section 18 of cloth. From this first end 58 the length of the soutache 56 is positioned adjacent the perimeter edge 50 of the cloth piece. The length of soutache 56 is attached to the perimeter edge 50 by zigzag stitching 60. The length of soutache is sewn to the entire perimeter edge 50 of the cloth piece and the second end 62 of the length is tucked underneath the second edge 48 of the bottom section 18 adjacent the first end 58 of the soutache.

Other types of trim may be attached to the perimeter edge 50 of the cloth piece in a similar manner to those described above.

Figure 8:
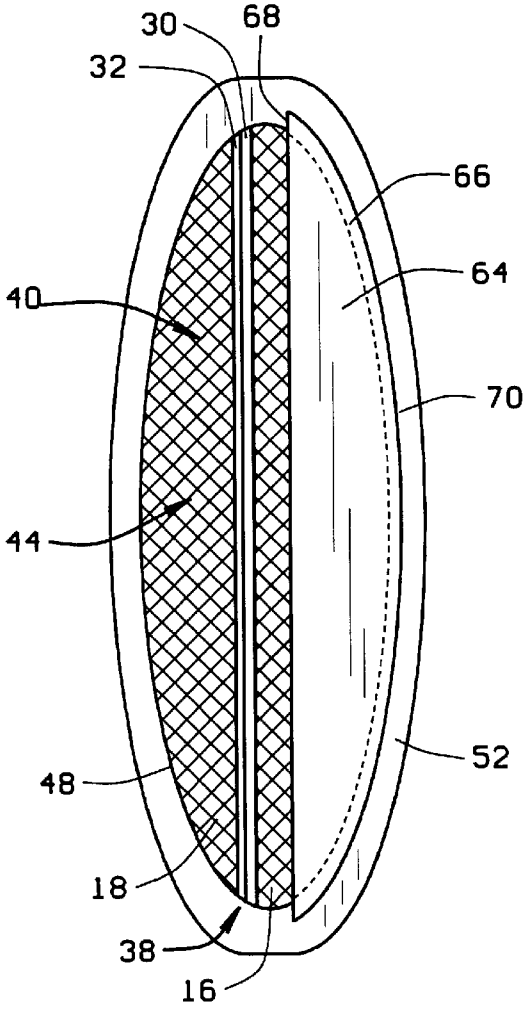
FIG. 8 is a plan view of the opposite side of the cloth piece with a foam layer attached.

The cloth piece 50 with the trim 52, 56 attached is then turned over and a layer of foam 64 is placed on the opposite side 44 of the cloth piece behind its right side 42. In the preferred embodiment the layer of foam is one-quarter inch thick and is cut with an inch and a quarter width and a length corresponding to that of the top section 14 of the cloth piece as shown in FIG. 8. The layer of foam 64 is then sewn to the opposite side 44 of the cloth piece along a line of stitching 66 that corresponds to a portion of the line of stitching that secures the trim 52, 56 to the cloth piece. Any excess of the layer of foam 64 is trimmed away so that one longitudinal edge 68 of the layer of foam is adjacent the seam 36 between the top and intermediate cloth sections 14, 16 and the opposite longitudinal edge 70 of the foam layer curves along the middle of the width of the racetrack trim 52 or adjacent the soutache trim 56. If a thicker material is used in constructing the top and bottom sections 14, 18, for example felt, then the step of attaching the layer of foam could be omitted if desired.

Figure 10:
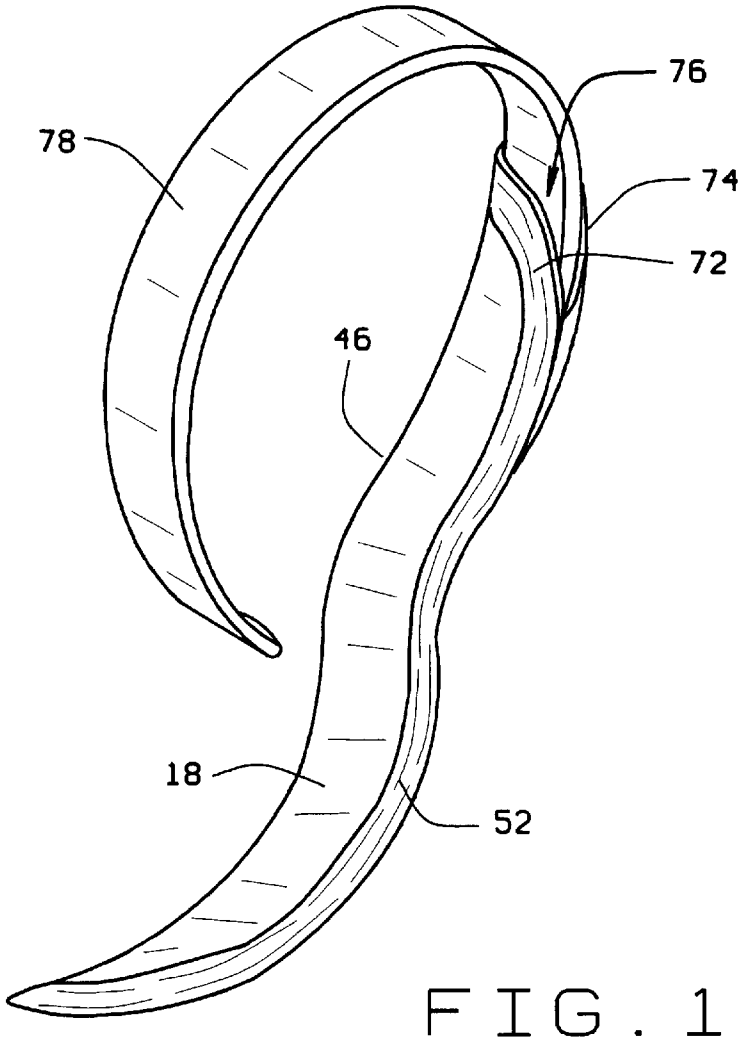
FIG. 10 is a perspective view showing insertion of a resilient hoop into the headband.
Figure 9:
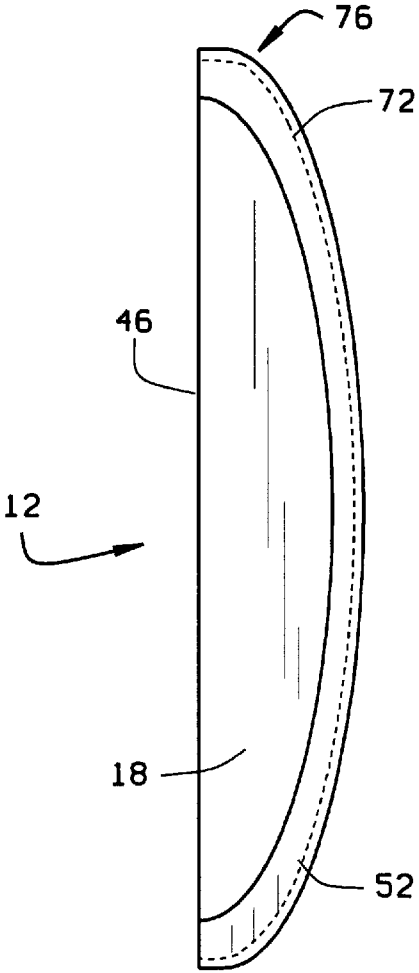
FIG. 9 is a plan view of the folded cloth piece.

The cloth piece 40 is then again folded over the fold 46 in the top section with the sewn seams 36, 38 within the fold as shown in FIG. 9. The portion of trim, whether racetrack or soutache, sewn along the second edge 26 of the top section 14 is positioned slightly outwardly (or to the right as shown in FIGS. 9 and 13) where it overlaps the portion of the trim sewn along the second edge 48 of the bottom section. The top section and bottom section are then sewn together along the overlapping trim except for two segments 72, 74 of the trim adjacent an end of the fold 46. These two segments 72, 74 of the trim define a gap 76 for the later insertion of the resilient hoop into the tubular sleeve form of the headband. The headband is then pressed on a curved block to give it a roundness to match the curvature of the head. After the pressing, a resilient hoop 78, such as a commercially available plastic resilient hoop, is inserted through the gap 76 between the trim sections as shown in FIG. 10. The resilient hoop 78 is inserted to the extent that it is entirely contained in the headband. The gap 76 in the trim is then sewn closed, completing the construction of the headband as shown in FIG. 1. If desired, additional decorative trim can be added to the completed headband 12.

The method of construction defined above produces a headband having a top cloth section 14 that is predominately visible when the headband is worn, except for the trim visible at the front of the headband. The intermediate cloth section 16 is positioned toward the rear of the headband and beneath the curve or fold 46 formed in the rear of the top section, and together with the bottom section of cloth 18 rests on the head of the wearer. The trim 52, 56 extends along the forward edge of the headband and is visible at the forward second edge of the top section of cloth 14. A portion of the trim 52, 56 along the second edge of the bottom section 18 is positioned beneath and behind the portion of trim 52, 56 on the second edge of the top section and is not readily visible when the headband is worn. The three different sections of cloth employed as well as the trim give the headband an elaborate design appearance that would appear to require costly time consuming construction, but is inexpensively manufactured by the simplified steps of the method set forth above.

While the present invention has been described by reference to a specific embodiment, it should be understood that modifications and variations of the invention may be constructed without departing from the scope of the invention defined in the following claims.

What is claimed:

1. A method of constructing a headband, the method comprising:

providing a piece of cloth having a longitudinal length and a lateral width;

forming a fold in the piece of cloth by folding over the piece of cloth across its lateral width and along its longitudinal length so that laterally opposite edges of the piece of cloth are adjacent;

sewing together the adjacent laterally opposite edges forming a tubular sleeve having a longitudinal length corresponding to the longitudinal length of the piece of cloth; and inserting a resilient hoop into the tubular sleeve.

2. The method of claim 1, further comprising:

sewing trim material around a perimeter of the piece of cloth prior to the piece of cloth being folded across its lateral width and sewing the laterally opposite edges of the piece of cloth together.

3. The method of claim 1, further including:

sewing a layer of foam material to the piece of cloth along a portion of a perimeter edge of the piece of cloth prior to the piece of cloth being folded across its lateral width and the laterally opposite edges of the piece of cloth being sewn together.

4. The method of claim 3, further comprising:

enclosing the layer of foam material in the tubular sleeve.

5. The method of claim 1, further comprising:

the piece of cloth has a perimeter edge and overlapping two portions of the perimeter edge by forming the fold in the piece of cloth, then sewing the two overlapped portions of the perimeter edge together except for segments of the perimeter edge adjacent the fold in the piece of cloth leaving a gap between the segments of the perimeter edge, and then inserting the resilient hoop through the gap and into the tubular sleeve.

6. The method of claim 5, further comprising:

securing the gap closed after the resilient hoop is inserted through the gap.

7. The method of claim 1, further comprising:

forming the piece of cloth from a top section of cloth having a longitudinal length and a lateral width between laterally opposite first and second longitudinal edges of the top section of cloth and a separate bottom section of cloth having a longitudinal length and a lateral width between laterally opposite first and second longitudinal edges of the bottom section of cloth, connecting the first longitudinal edge of the top section to the first longitudinal edge of the bottom section and folding the top section over the bottom section in forming the fold in the piece of cloth.

8. The method of claim 7, further comprising:

also forming the piece of cloth from an intermediate section of cloth separate from the top and bottom sections and having a longitudinal length and a lateral width between laterally opposite first and second longitudinal edges of the intermediate section of cloth, and connecting the first longitudinal edge of the top section to the first longitudinal edge of the bottom section by sewing the first longitudinal edge of the top section to the first longitudinal edge of the intermediate section and sewing the first longitudinal edge of the bottom section to the second longitudinal edge of the intermediate section.

9. The method of claim 8, further comprising:

forming the fold in the piece of cloth by folding the sewn top, intermediate and bottom sections over so that the second longitudinal edge of the top section is positioned adjacent the second longitudinal edge of the bottom section.

10. The method of claim 9, further comprising:

forming the tubular sleeve by sewing together the adjacent second longitudinal edge of the top section and the second longitudinal edge of the bottom section.

11. The method of claim 9, further comprising:

sewing together the adjacent second longitudinal edge of the top section and the second longitudinal edge of the bottom section except for segments of the longitudinal edges adjacent the fold leaving a gap between the segments, and then inserting the resilient hoop through the gap and into the tubular sleeve.

12. The method of claim 11, further comprising:

securing the gap closed after the resilient hoop has been inserted through the gap.

13. The method of claim 8, further comprising:

sewing trim material around a perimeter of the piece of cloth formed by the stop, intermediate and bottom sections of cloth.

14. The method of claim 8, further comprising:

sewing a layer of foam material to the top section of cloth along the second longitudinal edge of the top section and then forming the fold in the piece of cloth by folding the sewn top, intermediate and bottom sections of cloth over the layer of foam material.

15. A method of constructing a headband, the method comprising:

providing a top section of the headband from a first piece of cloth having a longitudinal length and a lateral width;

providing an intermediate section of the headband from a second piece of cloth having a longitudinal length and a lateral width;

providing a bottom section of the headband from a third piece of cloth having a longitudinal length and a lateral width;

sewing a first longitudinal edge of the top section to a first longitudinal edge of the intermediate section;

sewing a second longitudinal edge of the intermediate section to a first longitudinal edge of the bottom section;

folding the sewn top, intermediate and bottom sections over so that a second longitudinal edge of the top section is positioned adjacent a second longitudinal edge of the bottom section;

sewing the second longitudinal edge of the top section to the second longitudinal edge of the bottom section forming a tubular sleeve having a longitudinal length corresponding to the longitudinal lengths of the top section, intermediate section and the bottom section; and inserting a resilient hoop through the tubular sleeve until the hoop is entirely contained in the tubular sleeve.

16. The method of claim 15, further comprising:

sewing trim material around a perimeter of the sewn together top, intermediate and bottom sections of the headband prior to folding over the top, intermediate and bottom sections.

17. The method of claim 15, further comprising:

sewing together the adjacent second longitudinal edge of the top section and the second longitudinal edge of the bottom section except for segments of the longitudinal edges adjacent the fold leaving a gap between the segments, and then inserting the resilient hoop through the gap and into the tubular sleeve.

18. The method of claim 17, further comprising:

securing the gap closed after the resilient hoop has been inserted through the gap.

19. A headband comprising:

a top section of cloth having a longitudinal length and a lateral width with laterally opposite first and second longitudinal edges;

an intermediate section of cloth having a longitudinal length and a lateral width with laterally opposite first and second longitudinal edges, the first longitudinal edge of the intermediate section is sewn to the first longitudinal edge of the top section; a bottom section of cloth having a longitudinal length and a lateral width with laterally opposite first and second longitudinal edges, the first longitudinal edge of the bottom section is sewn to the second longitudinal edge of the intermediate section and the second longitudinal edge of the bottom section is sewn to the second longitudinal edge of the top section, forming a tubular sleeve; and a resilient hoop contained in the tubular sleeve.

20. The headband of claim 19, wherein:

trim material covers over both the second longitudinal edge of the top section and the second longitudinal edge of the bottom section.

* * * * *